US005425814A

United States Patent [19]

Krajicek et al.

[11] Patent Number: 5,425,814

[45] Date of Patent: Jun. 20, 1995

[54] METHOD FOR QUICK TURNAROUND OF HYDROCARBON PROCESSING UNITS

[75] Inventors: Richard W. Krajicek; Nismanath Mehta, both of Houston, Tex.; James R. Duffy, Chesterfield, Mo.

[73] Assignee: Serv-Tech, Inc., Houston, Tex.

[21] Appl. No.: 261,423

[22] Filed: Jun. 17, 1994

Related U.S. Application Data

[63] Continuation-in-part of Ser. No. 61,187, May 13, 1993, Pat. No. 5,389,156, and a continuation-in-part of Ser. No. 998,556, Dec. 30, 1992, Pat. No. 5,356,482, which is a continuation-in-part of Ser. No. 805,367, Dec. 10, 1991, abandoned.

[51] Int. Cl.[6] ..... B08B 3/00; B08B 9/00

[52] U.S. Cl. ..... 134/22.1; 134/22.14; 134/22.19; 134/22.15; 134/30; 134/31; 134/34; 134/11; 134/10; 134/39; 134/26; 134/19

[58] Field of Search ..... 134/22.1, 22.14, 22.19, 134/22.15, 30, 31, 34, 11, 10, 39, 26, 19

[56] References Cited

U.S. PATENT DOCUMENTS

| | | | |
|---|---|---|---|
| 1,722,211 | 7/1929 | Guardino | 134/22.15 |
| 1,891,592 | 12/1932 | Fitzgerald | 134/31 |
| 2,023,496 | 12/1935 | Todd | 134/22.15 |
| 2,715,594 | 8/1955 | Garrison | 134/22.15 |
| 3,084,076 | 4/1963 | Loucks et al. | 134/22.15 |
| 4,446,044 | 5/1984 | Rutkiewic et al. | 252/170 |
| BI4,511,488 | 9/1990 | Matta | 252/162 |
| 4,790,951 | 12/1988 | Frieser et al. | 252/162 |
| 5,271,773 | 12/1993 | Hamilton et al. | 134/10 |

OTHER PUBLICATIONS

Aksoy, M. "Benzene Carcinogenicity", CRC Press, Inc., Boca Raton, Florida (pp. 34–39, 50–53) No date.

"Toxicological Profile for Benzene", Oak Ridge National Laboratory, May 1989 (pp. 3–5, 7–12, 32–34, 39–41, 44, 68).

*Primary Examiner*—David A. Simmons
*Assistant Examiner*—Zeinab El-Arini
*Attorney, Agent, or Firm*—John R. Kirk, Jr.; Jenkens & Gilchrist

[57] ABSTRACT

A quick cleaning method for hydrocarbon processing is described which avoids using the time honored steam-out as a cleaning step by isolating the equipment to be cleaned from the rest of the hydrocarbon processing units, establishing a circulation loop and by pumping through the equipment an aqueous solution at an elevated temperature, of an extractant, such as a terpene, and a surfactant mixture which extracts and traps contaminants in an emulsion which is normally subjected to a high shearing step before recirculation to the equipment.

29 Claims, No Drawings

METHOD FOR QUICK TURNAROUND OF HYDROCARBON PROCESSING UNITS

RELATED APPLICATION

This application is a continuation-in-part of applications Ser. No. 08/061,187, filed May 13, 1993, now U.S. Pat. No. 5,389,156, and a continuation-in-part of Ser. No. 07/998,556, filed Dec. 30, 1992, now U.S. Pat. No. 5,356,482 which was a continuation-in-part of application Ser. No. 07/805,367, filed Dec. 10, 1991, now abandoned.

FIELD OF THE INVENTION

This invention relates to the decontamination of hydrocarbon process equipment and vessels to remove contaminants, particularly benzene, to clean the equipment during turnaround periods of short duration or to restore efficiency to pieces of equipment which experience premature fouling. Specifically, it involves a unitary cleaning of all, or part, of the proces equipment in a hydrocarbon flow-path which allows an extractant-based decontamination solution to be introduced into the processing system or equipment at a desired location in the process stream being cleaned and to recover it at almost any arbitrary location for disposal or reuse.

BACKGROUND OF THE INVENTION

In the chemical process and petroleum refining industries, maintenance and capital improvements of process plants normally occur at planned intervals, often three to seven years apart in the case of large petroleum refineries. Even if scheduled annually or biannually, cleaning is attempted when the operating unit is completely shut down and every aspect of its operation inspected and maintained. Operating units in hydrocarbon processing plants are made up of various types of vessels; i.e., tanks, heat exchanges, distillation columns, heaters, reactors and the like in fluid communication with each other. Characteristically, in refining and petrochemical operations, a feed, such as crude oil, is introduced to one end of the plant, with hydrocarbon product streams being removed at the other end, either to storage or to facilities for transportation to market. Of course, any similar process flow-stream equipment is also cleaned. This massive maintenance effort on each unit is called a turnaround and maximum speed in returning the unit to operation is essential to the plant economics, since the overriding cost of such an operation, even though itself expensive, is the time during which this operating unit is not producing refined product which can be sold. The speed at which the jobs are done are, of course, tempered with the necessity that safety of the workers be maintained throughout the operation.

Hydrocarbon processing equipment is designed for operation with various hydrocarbon feedstreams for a certain period of time to normally concur with the time lapse between scheduled turnarounds. For instance, a heat exchanger may be over designed so that, as its efficiency falls off due to fouling and contamination from operation, it passes through an optimum level of heat transfer efficiency to a level of toleration which diminishes as the time for the turnaround procedure approaches. It is not uncommon that, during operation of hydrocarbon processing plants, particularly crude oil heaters in refineries which operate in parallel with each other, some particular units will become less efficient at a much faster rate than others. For example, the efficiency of a single crude oil heater in a process stream can cause an overall decrease in the operational capacity of the entire refinery, thus causing a considerable depression of the economics of the refinery. The choice becomes whether to keep operating until a scheduled turnaround or to shut down the entire refinery for a long period of time in order to bring the overall efficiency back to a satisfactory level. Such a work stoppage would result in premature expense to maintain some of the equipment merely to bring one or two pieces of equipment up to par.

Normally, a turnaround operation for a large hydrocarbon processing plant may take three weeks to greater than a month of intensive round-the-clock operations. While the copending applications describe some of the advantages in time-saving through the practice of certain related inventions, the only alternative heretofore practiced in connection with the cleaning of these particular units has been to shut them down and then attempt to remove fouling through the injection of steam into the process equipment or unit. Initial injection of steam serves to remove hydrocarbons and volatile materials from the interior of the equipment. However, continued injection of high temperature steam often serves only to bake a scab of hard coke or scale on the walls of hydrocarbon processing units. Once this occurs, the only alternative is to disassemble the equipment and to proceed with cleaning of the parts in more conventional ways such as through hydroblasting with a high-pressure stream of water. A build up of carbon on heat exchanger tubing can cause hot spots to develop in the equipment resulting in erratic operation of the processing unit.

The present cleaning practice, depending upon the equipment, uses a light hydrocarbon solvent to initially remove heavy oils and tars, followed by injection of steam for a period of time until monitoring devices indicate that no dangerous gases remain which present an explosive hazard to workers who must work in this environment. This period of preliminary steam cleaning is called a "steamout" and has been known to last for days, even weeks on occasion. Process equipment was also washed with water to remove contaminants where applicable, and often, both steaming and water washing is involved in the degassing of a vessel to make it possible for humans to safety enter to inspect and repair. Frequently, acids or detergents were also used to remove stubborn deposits. These steps often take many hours, even days, to accomplish—days of lost production.

Of particular importance to worker safety is, in addition to elimination of explosive gases, the removal of benzene and other volatile organic carbon components, many of which are known carcinogens, from the process vessels prior to worker entry, if required. It has been long recognized that chronic exposure by humans to benzene at high levels in the chemical and petrochemical work place leads to bone marrow depression, aplastic anemia, and leukemia. Although absorption of benzene across the skin as a vapor or in aqueous media can occur, benzene toxicity in process systems is most frequently caused by inhalation of benzene that has managed to escape removal. Present government safety standards for eight hour work days are set at 1.0 ppm (average) benzene. The National Institute For Occupational Safety And Health (NIOSH) has recommended (1989) an occupational long term exposure limit in air of 0.1 ppm benzene. That is not good enough, since workmen employed by turnaround service companies are continually exposed to the interior of process vessels. Worker safety regulations now limit such exposure. One major goal of the present invention, therefore, is to provide a process for process equipment decontamination which exceeds this standard—in fact, which approaches, if not meets, 0 ppm of benzene. Benzene is often found collecting in head space of a vessel or trapped beneath scale or other contaminants anywhere along the proces flow stream—in piping, in valves, and in pumps, as well as towers, reactors, tanks and heat exchanges—only to seep out from the interstices of contamination deposits at a later time when cleaning had been thought to be completed.

In this era of quality management, when a particular piece of process equipment has lost its efficiency and requires cleaning in order to return the entire operating unit to useful efficiency, a procedure is needed for quickly accomplishing such cleaning and return to service through the removal of scales, absorbed hydrocarbons, cokes and other contamination from equipment and heat exchange surfaces without disturbing the entire unit when possible and certainly without requiring a prolonged shut down. Previously, such shut downs could last for weeks while extensive steaming and contamination removal continued during a steamout operation. The procedures required for such a cleaning, until now, are substantially described above. Where a single piece of process equipment rather than the entire unit is involved, it is necessary to unbolt flanges and install blinds to isolate the equipment while steam is introduced. Previously, when steam was used, venting to the atmosphere was allowed. Venting is no longer permissible under responsible environmental management, yet the steamout is strongly extended technology.

Even though there are many conflicting problems which converge on cleaning process equipment, the overriding requirements are still speed with safety, and the practice of this invention accomplishes these while providing avenues for a more effective protection of the environment. This invention allows almost pristine cleaning of process equipment—from the crude oil feed pump to product storage tank and any step along the way—without time-honored steamout in terms of hours, rather than days or weeks.

SUMMARY OF THE INVENTION

This invention involves an improvement over old methods of cleaning and decontaminating process equipment where a steamout step was used. In the present invention the process equipment is cleaned by introducing, at any convenient, arbitrary location of the equipment an aqueous solution of an extractant having an affinity for the contaminant and an emulsifying surfactant such that the aqueous solution proceeds through the equipment being cleaned including piping, pumps and process equipment (except for those selected by plant personnel which may be harmed by the introduction of non-process substances). The aqueous solution can be discarded in an environmentally benign way or reused. The process of this invention uses materials which are nonhazardous, which do not create additional waste, and which can be disposed of by merely introducing them into the plant's waste water system where they can be handled by the biosystem on a routine basis.

Initially, the processing system equipment may be drained while hot and flushed with a light hydrocarbon solvent to make an initial cleansing, although not absolutely necessary in the practice of the invention. Where desired or necessary, flanges are released and blinds are set in place in order to isolate the equipment to be cleaned from the rest of the unit. A line which leads from a circulation pump is attached to an intake flange of the equipment to be cleaned. The intake side of the pump is connected to a reservoir of cleaning liquid, initially water, and is downstream from a high shear device which is preferably a filter having an opening of from about 5 to about 100 microns. The 40 micron filter is best. The filters have been found to enhance the stability of the emulsion formed during the decontamination process. The contaminants removed from the system are trapped in the dispersed or discontinuous oil phase of the emulsion. Under certain conditions, the high shear operation of the filter is important to the success of the practice of this specialized cleaning operation. The act of pumping the solution or emulsion itself causes some shearing force to be applied. In some instances, this is enough.

A sufficient amount of water would be introduced into the process flow equipment to provide a head for pumps, preferably the process pumps where possible, to be used to circulate it through the process flow equipment to be cleaned. The amount of water would be from about 5 to about 25% of the volume of the system. If a heat exchanger alone is to be cleaned then it would be necessary to assure that it would be substantially filled during circulation either through back pressure created in the system or by simply adding more water. Steam or another means would be used to heat the water, now circulating, and process equipment from the injection inlet to the exit to a temperature of from about 100° F. to about 220° F. or higher if the system is operating under pressure. The cleansing injection is continued by incorporating into the circulating hot water an extractant, having a high vapor pressure at the temperature involved, having an affinity for the contaminating material being removed, such that the vapors will condense on equipment surfaces to invade deposited scale and trap the contamination connected with the scale. It is preferred that a surfactant which boils at, or has a high vapor pressure within, the same temperature parameters also be included with the aqueous solution being circulated to enhance the invasion of the interstices of deposits containing contaminants and wash down of the internal surfaces of the process equipment with both condensed water and extractant. The circulating water heated by the steam, or some other means, also contains extractant and surfactant, if present, and in addition to sweeping contaminants from the system, serves to perform the cleaning function upon the surfaces contacted by it. The high shear device (40$\mu$ filter) enhances the stability of emulsion which contains the contaminant extracted from the process equipment.

A terpene extractant material is preferred because it is known to be environmentally safe, does not harm the ozone layer and its boiling point and vapor pressure and the solubility of hydrocarbon contaminants in the extractant. Even if the surfactant and extractant do not boil in the temperature range of the treatment, if the partial pressure of these two components is sufficiently high at cleaning conditions, vapors will be dispersed throughout the process equipment loop being cleaned and will condense to invade the interstices of the contaminant material and matrix of hydrocarbon scale to assure extraction and removal of the contaminants. It has been discovered that this process is particularly effective in thoroughly removing benzene from the equipment and causing a disintegration of the hydrocarbon scale to leave the equipment almost pristine in a very short period of time. The solids break down so completely that they, in fact, are transported through the micron sized filter, particularly the preferred 40 micron size filter in the shearing operation of the practice of this invention. This shearing step assists the captivity of normally volatile carcinogenic aromatic hydrocarbons like benzene. If a knock-out zone or drum, preferably upstream of the filter, is used in the circulation loop, then larger sized solids can be collected.

The chemical formulations useful in the invention are capable of emulsifying and dissolving a wide range of typical hydrocarbon process industry contaminants such as tars, resins, and asphaltenes that might normally have been removed using aromatic or aliphatic solvents (some of which may be carcinogenic or teratogenic) and strong alkaline-based detergents. The decontamination solutions of this invention are not aggressive; they are non-reactive, and safe for use with the metallurgy normally found within hydrocarbon processing units. This characteristic allows the circulation of the decontamination solution using the standard process pumps already in place, thus allowing full and maximum use of system pressure and design fluid flow ratings without the damage to pump seals and packing which had been experienced during cleaning using reactive chemicals. In fact, the flow of the present chemical formulations may be controlled and monitored from the chemical plant's own control room. Surprisingly, observation of the interior of the equipment after cleaning approximates the appearance of new equipment. The surfaces are so clean that, in the case of mild steel, a patina of oxidation quickly forms upon exposure to air. Even more surprising is the ability to complete cleaning for disassembly and inspection is from about 10 to about 36 hours on jobs previously requiring from five to ten times as long; i.e., cleaning is accomplished in from about 10% to about 20% of the time.

DETAILED DESCRIPTION OF THE INVENTION

The method of this invention allows the owner of hydrocarbon processing units to clean process equipment or looped collections of equipment in a very short period of time without the necessity to resorting of the use of steam as the cleaning agent for equipment to remove contamination and scales and other deposits from hydrocarbon processing equipment as was previously required, i.e. without a steamout step. The steamout requires long periods of time and often exacerbated the problem of cleaning out tars and cokes. The cleaning method taught by this application is quick, amounting only to a matter of hours before the equipment could be opened for inspection as opposed to days previously when a steamout was required for safety. This allows reduced down time and in the case of badly fouled equipment reducing efficiency of the hydrocarbon processing unit can bring it back to full capacity without complete turnaround. Once the equipment being cleaned is shut down and drained, it is isolated through blinds, or blanks, most likely inserted at the flanges, and separated from the balance of the hydrocarbon processing unit, lines are installed to create a circulation loop through the isolated equipment. If necessary, pumps and a shearing unit are inserted in the loop. The practice of the method of this invention avoids the problem with the baking coke deposits into the units where a steamout step was previously used. Further, it takes advantage of the use of extractants which meet the Montreal protocol concerning the release of hydrocarbon to the atmosphere just in case an emission does occur. The practice of this invention even allows the removal of hydrocarbon fouling in a packed tower in a period of from 5 to 6 days without the physical removal of the packing from the tower.

In the practice of the method of this invention which eliminates the "steamout" step universally followed in the cleaning of the hydrocarbon units, the equipment, or entire hydrocarbon processing unit, may be shut down and drained as completely as possible. It would then normally be flushed by circulating a light solvent through it such as a sweet crude or naphtha, kerosene or diesel cut. If it is a single piece of equipment or several pieces of equipment in fluid communication with each other, appropriate blanks are inserted into the flanges between this equipment and equipment which is not to be cleaned in this step. After the equipment is isolated a fluid circulation loop is established through the equipment to a shearing means, like a filter, through a pump which can be upstream or downstream from the shearing means and back to the equipment. The equipment to be cleaned is filled with water up to about 5% to about 25% of the volume of the system, as long as the amount of water is sufficient to cover the pump intakes while circulating the cleaning fluid; provided, however, the amount of water must be sufficient that heat exchanges are filled either by the rate of circulation or through addition of more water.

Process pumps or extraneous pumps may be brought to bear on the operation, but a conduit for the solution is attached to the equipment where entry of the cleaning material is desired with a second conduit for the fluid attached at the exit. In the loop through which the fluid will be circulated includes a shearing means which can either be a static in-line mixture or a filter having a filter size of from about 1 to about 100 microns, preferably from about 20 to about 60 microns, and most preferably 40 microns plus or minus 15%, to provide shear to stabilize the emulsion created by the extractant, surfactant and the contaminants and solids removed from the equipment. A stable oil-in-water emulsion to be formed with extremely small particle size is caused by the combination of the shearing action and the ability of the extractant to break down the agglomerated scale or deposits on the equipment surfaces.

The water in the equipment is circulated and heated to bring it to a temperature of from about 100° F. to about 220° F. The preferred method of heating is to inject steam into the water to raise its temperature and add the extractant and emulsifying agent to the heated water to form the cleaning solution. The extraction strength and emulsion forming capability of the circulating solution can be balanced by simple sampling and testing well-known in the art and adjusted as necessary during the cleaning process. The sampling and testing accomplishes a second purpose in that once the removal capacity of the extractant and surfactant has been exceeded there would be a tendency for the emulsion to invert where the water would become the discontinuous phase and the oil the continuous phase. At such time, it would be necessary to add more extractant and surfactant to reverse the invert phenomenon. The circulation is continued until the fouling content of the cleaning solutions stabilizes, indicating that the removal of additional contamination is probably not to occur. This normally occurs within 6 to 12 hours. The material is then drained, the equipment flushed with water and opened for inspection to assure the restoration of the equipment to full operational capacity. For equipment like process vessels, towers, reactors and heat exchanges this occurs some 20 to 30 hours after the unit is shut down as opposed to days or even weeks with the old steamout cleaning method. Even with days of steamout questions remained about whether cleaning was complete remained.

The cleaning process of this invention is applicable to almost any, if not all, hydrocarbon processing equipment as long as it can be isolated from adjacent equipment. For example, the method may be used to clean any equipment within the normal refining and hydrocarbon processing industry. For example, the units would include, but not be limited to, crude oil units, vis-breaker systems, hydrocrackers, hydrotreaters (including the reactor), fluid cat cracking systems (except for the cracking unit itself), delayed coking units, ethylene thermal crackers, amine units and other associated vessels. For example, each of the units would have heat exchanges associated with them and some involve direct heating furnaces, such as, for example, the crude unit train. When high temperature hydrocarbon processing equipment is used, the prospect of coking occurs and it has surprisingly been found that the method of this invention has a salutary effect on the decoking of heaters and equipment while avoiding the troublesome steamout step.

One of the great advantages of the cleaning method of this invention is its flexibility with respect to the ability to clean the entire process equipment or any parts thereof. Simply stated, the steps of the invention involves the shutdown and draining of the entire process plant, whether a petroleum refinery, a petrochemical plant, or the like. Normally, this draining will occur while the plant equipment is still hot, followed by an optional flush, usually with a light solvent, to remove soluble hydrocarbons. Flanges would be opened with blinds inserted to isolate the equipment to be cleaned. Of course, where there are valves in the system, they can be closed making insertion of blinds unnecessary unless these are plans to perform maintenance on the valves. A circulation loop and pumps, if needed, and shearing filter, if needed are installed.

A sufficient amount of water would be introduced into the process flow equipment to provide a head for pumps, preferably the process pumps, to be used to circulate it through the process flow equipment to be cleaned. Circulation through the system would preferably be at a rate to generate at least about turbulent flow. Normally, this flow rate would be from 500 to about 5,000 gallons per minute depending upon the size of the plant equipment and pumps used to accomplish the circulation. The preferable flow rates would run from about 800 to about 1,400 gallons per minute.

The stabilizing influence of the turbulent flow of the material circulating through the equipment is enhanced by insertion in the loop of a shearing means which additionally enhances the stabilization of the emulsion and, hence the removal capacity of the fluid greatly contributing to the reduced time for completion of the cleaning process. The action of shearing the emulsion containing contaminants, especially suspended solids, causes most smaller sizes to result thus making it more easily held in the emulsion to prevent it from settling out in the equipment. This shearing means can be in the form of an in line static mixer such as a "Keenix" brand mixer or a filter or even an ultra filter having pore sizes of from 1 to about 100 microns or, preferably, about 40 microns plus or minus about 15%.

The amount of water introduced into the equipment being cleaned would be normally enough such that when the pumps are running at the desired flow rate, no cavitation would occur through lack of fluid in the intake of the pump and heat exchangers in the loop are filled. Normally, the amount of water introduced would be from about 5% to about 25% of the internal volume of the process flow stream being cleaned. Preferably, the amount would be from about 10% to about 18% of the internal volume. Back pressure may be created by installing orifice plates in flow lines during circulation to keep exchangers full to assure contact with all fouled surfaces. If not, more water can be added.

This would be followed by a circulation of water and then a heating of the equipment, preferably by the injection of steam into the water. Of course any residual heat in the units would aid in heating. Heating continues until the equipment and solution reaches a temperature of from about 100° F. to about 220° F., preferably from 120° F to about 180° F. In the case where the equipment is maintained under pressure the water could be heated to its boiling point for the existing conditions. The steam temperature could be up to about 375° F. to perform the heating step. This steam would probably be from the same source as previously used for the now unnecessary "steamout" step. Then an extractant and surfactant as defined herein are added to the circulating heated water. The high vapor pressure will cause it to be vaporized throughout the system which is not flooded with liquid ultimately condensing on inner surfaces and mixing with the heated water being circulated through the equipment, preferably using process pumps. The circulation continues for a sufficient period of time, preferably for about 8 hours to about 12 hours or until contamination is removed. It has been found that after about a circulation time of from about 10 to 20 hours is normally sufficient for opening the equipment for inspection. Even though experience with the practice of the invention has shown that the cleaning is sufficient to put the equipment back on line with greatly improved results, it is only prudent to inspect the equipment to assure that some dangerous fault has not occurred and to install new gaskets for continued operation.

The solution may be tested during circulation, using known procedures for the emulsifier activity remaining in the solution. If activity has diminished, or been exhausted, the solution could either be reconstituted by adding extractant and/or surfactant or it can be replaced entirely with virgin, heated aqueous solution. By adding a known amount of surfactant when the emulsifier activity is tested, the reduction in activity can indicate the level of cleaning. Once thorough cleaning is indicated, the equipment being cleaned is drained and rinsed with water. If the circulating chemicals are not spent, the cleaning liquid could be used as circulation fluid in another piece of equipment to be cleaned.

The contamination removed is held in an aqueous emulsion such that an emulsion breaker can be used, employing known techniques, to separate the water from hydrocarbon and from solids. As stated before, the stability of the emulsion is enhanced by the shearing forces placed upon the cleaning emulsion by the circulation rate, the pumps themselves, and the shearing means, particularly a filter having a small pore size. The hydrocarbon removed can be sent to a normal slop tank at the refinery and the recovered water to a biopond for biological remediation treatment. In the preferred embodiment of the invention the shearing means is best provided by using a truck-mounted tank having two chambers connected by a passageway including a filter of the desired size. The truck may include a circulation pump in case the process pumps are not available.

Using the steps of the present invention as described above results in almost pristine cleaning of the process equipment in much shorter periods of time as compared to prior art methods using steamout procedures, while also maintaining strict safety standards for personnel. The time savings are evident when cleaning a single piece of hydrocarbon processing equipment isolated from the entire unit by blind flanges. It is not uncommon that the equipment in a plant is contaminated with residual amounts of carcinogens such as benzene, xylene, toluene, and other hydrocarbons, both aromatic and aliphatic. The presence of these chemicals is detected with various devices and limitations have been set by health and environmental standards which can be safely contacted by humans or what amounts can be released to the environment, respectively. Thus, these materials must be removed before work and maintenance crews can safely enter a vessel for inspection or repair. Steamout and other cleaning methods and attempts, even using surfactants, fail to remedy the problem created by the volatile organics.

The extractant may preferably be introduced into the circulating water while injecting steam to heat the circulating water to a temperature of from about 160° F. to about 270° F., preferably from about 185° F. to about 210° F., and then adding the extractant to the circulating water to obtain a concentration of from about 0.1% to about 7% by volume, preferably, from about 1½% to about 5%.

The extractant is chosen from those having an affinity for the contaminant being removed. The criteria for selection are the solubility of the material being removed in the extractant and the vapor pressure of the extractant such that a significant amount in the vapor phase at the temperature of the circulating heated water to condense on the surfaces of the metal in the interstices in the metal. While some hazardous solvents may be used for a portion of the method of this invention, the extractant material should preferably be non-toxic and nonhazardous and selected such that it has a high vapor pressure. Thus, the partial pressure of the extractant will be significant at cleaning conditions.

Preferred extractants having affinity for the scales and contaminants normally found in a hydrocarbon processing unit include materials such as the various terpenes; including, for example, dipentenes, cinenes, cajeputenes, diamylenes, the oils of bergamot, geranium, citronella, dill, and caraway, and the like and related terpenes such as hermiterpenes (isoprenes), sesquiterpenes (caryophyllenes), diterpenes, and polyterpenes. The especially preferred extractant is limonene, particularly, d-limonene. Mixtures of several extractants may be used satisfactorily with the same criteria as set forth above. Consultation with well-known tables having vapor pressure information and simple experimentation to determine the affinity of the extractant for the contaminating material is all that is necessary to select the mixture and determine relative proportions.

The matter of selecting the satisfactory surfactant is also within ordinary skill in the art. The boiling point and vapor pressure criteria remain the same as for the extractant such that the surfactant will also condense at substantially the same time as water vapor and the extractant material condenses. This allows the cracks and crevices of the metal and internals of the entire process system, including interstices of the matrix of scaly contamination, to all be invaded by the components of this cleaning system to break down the scale and trap the contaminants into the solution (microemulsion) and remove the troublesome contaminants, especially volatile organics such as benzene.

The selected surfactants may be anionic, cationic, amphoteric or non-ionic, or mixture from several classes, but the selection specifically is within the experience of the skilled chemist, based upon the material being removed as the contaminant, the extractant being used and the relative amounts which are expected to be taken into the wash solution from the condensing steam or the circulating water wash. The HLB (Hydrophile/-Lyophile Balance) of the surfactants selected preferably should be between 6 and 18 and preferably, between about 7.5 and 12 for the optimum results in the practice of this invention. The characteristics of the members of these classes of surfactants are well known as are the many compounds within these classes. Many surfactants and/or emulsifiers may be selected for use in the practice of the invention depending upon the many and varied process streams which can be cleaned using this invention.

Preferred surfactants are selected from ethoxylated alkyl phenols having an average of from about 6 to about 12 moles of ethylene oxide per mole of alkylphenol, where the alkyl group contains from 8 to 10 carbon atoms. Another preferred component in a surfactant mix is a block copolymer of ethylene oxide and propylene oxide having a molecular weight of from about 1,500 to about 2,500. As a third component in the especially preferred embodiment is a fatty acid alkanolamide which may be and often is, available in commercial solutions as 50/50 mixture with a linear alkylbenzene sulfonic acid. Many variations on this theme are well within the scope of the practice of this invention and the components may be varied, as well as their constituents, without departing from the practice of this invention. Combinations of the foregoing materials are especially useful in creating a stable microemulsion with the preferred extractants; i.e., terpenes, and particularly d-limonene. A mixture as described above has a high range of volatility and is found to be useful in contacting and removing many different types of contamination found in hydrocarbon processing units.

Mixtures of surfactants in several of the classes an mentioned above may be used successfully, especially in the situation where a premix of extractant and surfactant is used. this premix would normally be in the form of a microemulsion of several extractants and surfactants. Often, several surfactants would be necessary in order to enhance the shelf life as a homogenous fluid, usually as a microemulsion with water acting as the discontinuous phase in the continuous phase terpene. Of course, the emulsion inverts in the presence of large amounts of water.

The amount of the mixture added to circulating liquid would result in an effective amount of the extractant and surfactant being present, usually at a concentration from about 0.1% to about 7%, preferably from 1½% to about 5%, and more preferably from about 2% to about 4%. the emulsification of contaminants is important to the successful position of this invention and those skilled in the art given knowledge of the contaminants and the description herein will be able, with slight experimentation, to select a useful mixture. The shearing step of the method of this invention also contributes to the successful stabilizing of the emulsion.

The practice of this invention substantially reduces the time and enhances the results of the cleaning, allowing the process equipment to be put back on stream sooner than previously when steamout was used either alone or even in connection with an improved process such as one similar to that described and claimed herein. As a particular advantage, the process equipment is free from volatile organic compounds (VOCs), especially benzene which is a known carcinogen. Prior attempts at decontamination left residual benzene contamination endangering workers who must enter the equipment.

For example, a preferred mixture of extractants and surfactants for cleaning a reaction vessel was prepared using the following components:

TABLE I

| (Mixture A) | Weight Percent |
|---|---|
| d-Limonene | 57% |
| Nonionic copolymer[1] | 09% |
| Monamulse 653-C[2] | 17% |
| Butyl Cellusolve | 03% |
| Nonionic surfactant[3] | 05% |
| Water | 09% |
| | 100% |

[1]Block copolymer of ethylene oxide and propylene oxide having a molecular weight of 1950 and HLB of 12 to 18.
[2]90% active ingredients of a 50/50 mixture of an ethanolamide of a $C_{12}$ fatty acid and a linear alkylbenzene sulfonic acid in 10% isopropanol, b.p. 205° F.
[3]10 mole ethylene oxide adduct of a nonlyphenol.

In another embodiment (Mixture B) , the 8% represented by the butyl cellusolve and the nonionic surfactant in the mixture is replaced by a 6 mole ethylene oxide adduct of nonylphenol with an HLB of 10.8.

The above-identified components, when mixed together, form a stable microemulsion of water in the terpene having a long shelf life and exhibiting good solvency for oils or greases, including the lighter materials such as benzene, toluene, and xylene which are trapped and held in the emulsion until removed from the process flow equipment in spite of the elevated temperatures at which the cleaning is performed.

The effluent from the decontamination process will be resolvable into hydrocarbons, solids, and water phases such that the hydrocarbons may be recovered and the water containing soluble light hydrocarbons (especially benzene) can be scrubbed or stripped using a suitable conventional gas stripping operation for environmentally safe disposal. The solids can be removed for incineration and disposal to a land fill.

Of course, the selection of the equipment which goes into the circulating loop will vary with respect to the hydrocarbon processing unit being cleaned and are selected using the parameters of the necessity for cleaning and the fluid communication through existing processing pipes. Of course, any equipment through which circulation is not desired then is isolated by the installation of blanks in the flow lines. A convenient place for introducing the fluid and removing the fluid is selected and the loop established.

The following example is a description of one such loop created in a hydrocarbon processing refinery to illustrate the operation of the above-described invention. It is offered for purposes of instruction to those skilled in the art and should not be considered as a limitation on the scope of the described invention as claimed.

EXAMPLE

A hydrogenation unit of a refinery was shut down and drained. Blanks were inserted to isolate the hydrogenation reactor to protect the catalyst from the cleaning solution. Blanks were also inserted to close off the feed line from the crude unit. The volume of the vessels to be cleaned which included a fractionation tower and several drum-type vessels, a fin fanned heat exchanger, as well as three shell and tube heat exchangers, was selected for cleaning. A truck mounted pump and shearing device having a 40 micron filter was used to complete the circulation loop by attaching temporary piping to draw fluid off the bottom of the tower and pumping to both of the drum vessels was set up. This allowed the cleaning solution to circulate throughout the system by varying the valving. The volume of the well water used as fill was 30,000 gallons which was introduced through one of the drum vessels and allowed to fill the system. Circulation was begun and steam introduced to heat the water to about 190° F. During circulation steam was periodically introduced to maintain the water temperature between a minimum of 180° F. and a maximum of 200° F. Mixture B (3,800 pounds) was introduced into the circulating water to result in approximately 1.5% of volume of the extractant/surfactant material circulating through the system. Circulation was continued for about 10 hours with periodic testing to determine the degree of contamination removal. When testing showed no changes in concentration, circulation was stopped (after about 10 hours), the circulating cleaning solution was pumped out of the hydrogenation unit to be used to assist cleaning the crude processing unit. Therefore, the crude line was reopened for the draining of the hydrogenation unit. Afterwards wash water circulated through the system, drained and the hydrogenation unit was opened for inspection. Examination of the unit showed that it was cleaner that previously experienced after conventional methods involving a steamout step and was accomplished in less than one fourth the time.

Similarly, other units of the refinery were shut down, drained with loops established and cleaning occurred by pumping at conditions as set forth in the hydrogenation unit with similar, if not identical, results. The equipment cleaned throughout the refinery was, when inspected, found to be cleaner than previously and this stage of the process, i.e. the removal of fouling from the surfaces of equipment, was accomplished much more quickly than previously when the steamout step was used. During prior similar operations a steamout was done as a matter of course.

Having described this invention and given exemplars thereof one of ordinary skill in the art having this description before them would be able to make many modifications and adjustments to the process without departing from the scope of the invention as claimed herein.

What is claimed is:

1. A method for cleaning and decontaminating hydrocarbon processing plant equipment to remove scales and chemical deposits without a steamout step comprising the steps of:

isolating the equipment to be cleaned from other process equipment;

establishing a fluid loop of the equipment to be cleaned, including a pump for causing fluid to circulate within the loop;

filling the equipment with sufficient water to cause any heat exchangers in the loop to be substantially full during circulation;

circulating the water through the loop;

heating the water to a temperature of from about 100° F. to about the boiling point of water;

adding a sufficient amount of an extractant chemical with an affinity for contaminants present in the equipment and a surfactant having emulsifying activity for said contaminant and extractant to said water to form a heated emulsion to clean the surface of the equipment;

contacting surfaces of the equipment to be cleaned with the heated emulsion;

circulating said heated emulsion at the temperature through the loop for a period of time sufficient to clean the contacted surfaces; and removing the circulating emulsion from the loop.

2. The method of claim 1 wherein the water fills from about 5% to about 25% of the volume of the equipment.

3. The method of claim 1 wherein the temperature of the circulating emulsion is from about 120° F. to about 180° F.

4. The method of claim 1 which includes circulating such emulsion through shearing means in the loop to stabilize such emulsion.

5. The method of claim 4 wherein the circulation through the equipment and shearing means is at a rate of from about 800 to about 1,400 gallons per minute.

6. The method of claim 4 wherein the shearing means is a filter having a pore size of from 1 to about 100 microns.

7. The method of claim 6 wherein the filter has a pore size of about 40 microns, plus or minus about 15%.

8. The method of claim 1 wherein the extractant is a terpene and the surfactant has a HLB of from about 6 to about 18.

9. The method of claim 8 wherein the terpene is d-Limonene and the surfactant comprises a 6 to 12 mole ethylene oxide adduct of an alkyl phenol wherein the alkyl group contains 8 to 10 carbon atoms, a block copolymer of ethylene oxide and propylene oxide having a molecular weight of from about 1,500 to about 2,500 and fatty acid alkanol amid.

10. The method of claim 9 wherein the terpene and surfactant mixture is from about 0.1% to about 7% by volume of the emulsion.

11. The method of claim 1 wherein the heating step occurs during circulation of water through the loop.

12. The method of claim 1 wherein the extractant chemical and surfactant are added to the water during one or more of the filling, circulating or heating steps.

13. The method of claim 1 wherein the extractant chemical and surfactant are added to the heated water.

14. A method for restoring efficiency in a hydrocarbon processing plant of process equipment to remove scales and chemical deposits and without a steamout step comprising the steps of:

draining the hydrocarbon process equipment of process fluids;

isolating the equipment to be cleaned from other process equipment;

flushing the hydrocarbon process equipment with a light solvent and filling the equipment with sufficient water to establish a head pressure for process pumps and fill heat exchangers during circulation;

circulating said water through the system while heating said water to a temperature of from about 100° F. to about 220° F.;

adding an extractant chemical with affinity for contaminants present in the equipment and a surfactant having emulsifying activity for said contaminants into said heated water to form a heated emulsion;

circulating said heated emulsion at a temperature of from about 100° F. to about 220° F. for a period of up to about 12 hours;

removing the circulating solution containing emulsified contaminants; and rinsing the hydrocarbon process equipment with water before returning the equipment to operational status.

15. The method of claim 14 which includes circulating such emulsion through a shearing means in the loop to stabilize such emulsion.

16. The method of claim 15 wherein the shearing means is a filter having a pore size from 1 to about 100 microns.

17. The method of claim 16 wherein the filter has a pore size of about 40 microns, plus or minus about 15%.

18. The method of claim 14 wherein the extractant is a terpene and the surfactant has an HLB of from about 6 to about 18.

19. The method of claim 18 wherein the terpene is d-Limonene and the surfactant comprises a 6 to 12 mole ethylene oxide adduct of an alkyl phenol wherein the alkyl group contains 8 to 10 carbon atoms, a block copolymer of ethylene oxide and propylene oxide having a molecular weight of from about 1,500 to 2,500 and fatty acid alkanol amid.

20. A method for cleaning and decontaminating hydrocarbon processing plant equipment to remove scales and chemical deposits on internal equipment surfaces without a steamout step comprising the steps of:

isolating the equipment to be cleaned from other processing equipment;

contacting surfaces of the equipment with an aqueous solution heated to a temperature of from about 100° F. to the boiling point of water, the solution containing an amount, sufficient to clean the surfaces of an extractant chemical with an affinity for contaminants present in the equipment and a surfactant having emulsifying activity for said contaminants and extractant, for a time sufficient to clean the contacted surfaces and form an emulsion; and removing the emulsion from the equipment.

21. The method of claim 20 which includes the step of replacing the removed emulsion with additional heated solution to repeat the contacting step.

22. The method of claim 20 which includes the steps of establishing a fluid loop of the equipment to be cleaned, including a pump for causing the fluid to circulate; and circulating the emulsion through the loop.

23. The method of claim 22 which includes circulating the emulsion through a shearing means within the loop to stabilize the emulsion.

24. The method of claim 23 wherein the shearing means is a filter having a pore size of from 1 to about 100 microns.

25. The method of claim 24 wherein the filter has a pore size of about 40 microns, plus or minus about 15%.

26. The method of claim 22 wherein the circulation at a rate of is from about 800 to about 1,400 gallons per minute.

27. The method of claim 20 wherein the extractant is a terpene and the surfactant has an HLB of from about 6 to about 18.

28. The method of claim 27 wherein the terpene is d-Limonene and the surfactant comprises a 6 to 12 mole ethylene oxide adduct of an alkyl phenol wherein the alkyl group contains 8 to 10 carbon atoms, a block copolymer of ethylene oxide and propylene oxide having a molecular weight of from about 1,500 to about 2,500 and a fatty acid alkanol amid.

29. The method of claim 28 wherein the terpene and surfactant is from about 0.1% to about 7% by volume of the emulsion.

* * * * *